United States Patent [19]

Sampa et al.

[11] Patent Number: 4,936,618

[45] Date of Patent: Jun. 26, 1990

[54] GRAPPLE CONNECTION FOR COILED TUBING

[75] Inventors: Augdon Sampa, Stafford; Bart Thomeer, Houston, both of Tex.

[73] Assignee: Dowell Schlumberger Incorporated, Tulsa, Okla.

[21] Appl. No.: 328,668

[22] Filed: Mar. 27, 1989

[51] Int. Cl.[5] ..... F16L 35/00; E21B 31/02

[52] U.S. Cl. ..... 294/86.31; 285/39

[58] Field of Search ..... 285/39; 294/96.26, 86.3, 294/86.31, 119.1

[56] References Cited

U.S. PATENT DOCUMENTS 1,640,847 8/1927 Neilson ..... 294/86.31
1,734,338 11/1929 Neilson ..... 294/86.31
3,191,981 6/1965 Osmun ..... 294/86.31
3,727,967 4/1973 Anastosia et al. ..... 294/86.31

*Primary Examiner*—Dave W. Arola
*Attorney, Agent, or Firm*—Stephen A. Littlefield

[57] ABSTRACT

A grapple connection for interconnecting coiled tubing with a well tool comprises first and second tapered split rings and a double-tapered intermediate split ring enclosed in a cylindrical, threaded housing.

When the housing is rotated with threaded engagement of the housing to a compression ring and the well tool, the well tool and the compression ring bear against the split rings causing the tapered surfaces to press the grapples inwardly and the intermediate ring outwardly to effect a tight interconnection between the coiled tubing and the well too.

2 Claims, 1 Drawing Sheet

GRAPPLE CONNECTION FOR COILED TUBING

This invention relates to the art of subterranean well operations and, more particularly, to well service operations conducted with coiled tubing.

BACKGROUND OF THE INVENTION

Coiled tubing technology represents an efficient and inexpensive method for conducting well service operations without the use of a large well derrick. Various well tools including packers, spotting valves, logging tools, and the like can be conveniently attached to the end of coiled tubing and run into the well to perform well services. With the advance in highly deviated and horizontal well drilling technology, coiled tubing represents the primary means for placing logging tools within the wellbore since they can be forced horizontally on the end of the substantially rigid tube.

Coiled tubing is typically relatively small diameter seamed pipe and interconnection with the well tools can be present a problem, particularly if the coiled tubing is out of round. Common grapple-type connections between coiled tubing and well tools are relatively bulky and must be of relatively large size in order to maintain sufficient gripping force to hold the tool on the end of the coiled tubing.

SUMMARY OF THE INVENTION

The present invention provides a low-profile grapple connection which provides high holding power in gripping the coiled tubing while requiring only a minimum amount of space.

In accordance with the invention, the outer surface of coiled tubing is gripped by a pair of tapered, split grapple rings with an intermediate double tapered split collar. The grapple rings and double tapered split collar are retained in position by a cylindrical grapple housing having threaded end portions which engage a well tool on one end and a threaded rings on the opposite end. When the grapple housing is rotated on the threads of the tool and threaded ring, the tool and threaded ring bear against the tapered grapple ring, the tapers cooperating with the taper of the double-tapered wedge ring to force the grapples radially inwardly against the outer surface of the coiled tubing and force the double-tapered wedge radially outwardly against the housing thereby creating a strong grapple connection with the coiled tubing.

It is therefore an object of this invention to provide a low profile, lightweight grapple connection for connecting coiled tubing to a well tool.

It is yet another object of this invention to provide a strong grapple interconnection between the well tool and coiled tubing.

It is a still further object of this invention to provide a grapple connection which is less sensitive to out-of-round tubing.

BRIEF DESCRIPTION OF THE DRAWINGS

These and other objects of the invention are accomplished in the manner and form of the present invention to be described hereinafter in conjunction with accompanying drawings forming a part of this specification and in which.

DETAILED DESCRIPTION OF THE PREFERRED EMBODIMENTS AND THE DRAWINGS

Figure 1:
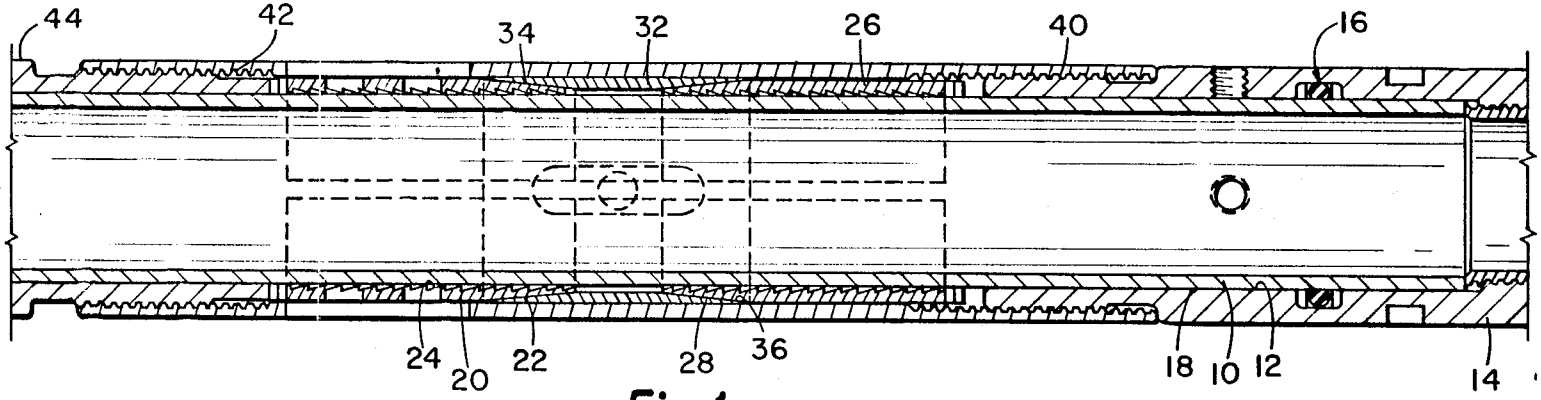
FIG. 1 is a cross-sectional view of a grapple connection between coiled tubing and a well tool in accordance with the present invention.

Referring now to the drawings wherein the showings are for the purpose of illustrating a preferred embodiment of the invention only and not for the purpose of limiting same, FIG. 1 shows a terminal end of coiled tubing 10 located within an inner bore 12 of a well tool 14. An O-ring 16 acts against the well tool 14 and the outer surface 18 of the coiled tubing 10 to seal tubing pressure within the assembly.

Figure 4:
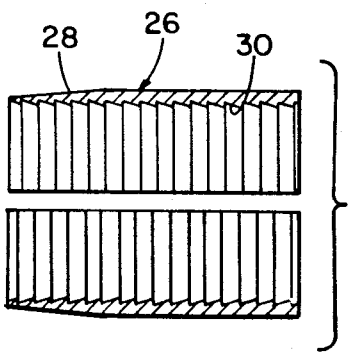
FIGS. 2, 3 and 4 are cross-sectional views of the tapered wedge ring components of the grapple connection in accordance with a preferred embodiment of the present invention.
Figure 3:
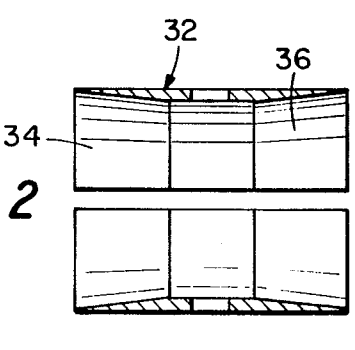
Figure 2:
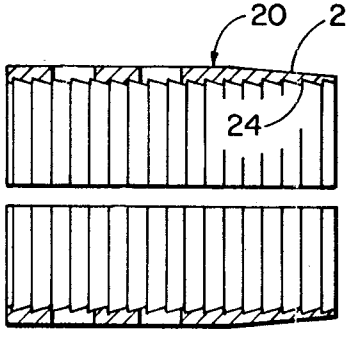

In accordance with the invention, a split upper wedge ring 20 (FIGS. 1 and 2) having a conically tapered outer surface 22 and a grapple threaded inner surface 24 engages the outer surface 18 of the coiled tubing 10. In a similar manner, a split lower wedge ring 26 (FIGS. 1 and 4) having a similarly conically tapered outer surface 28 and a grapple comprising buttress threaded inner surface 30 similarly engages the outer surface 18 of the coiled tubing 10. Intermediate the split upper wedge ring 20 and the split lower wedge ring 26 is a split double-tapered wedge ring 32 (FIGS. 1 and 3) having a pair of tapered inner surfaces 34, 36 in engagement with the conically tapered outer surfaces 22, 28, respectively, of the split upper wedge ring 20 and the split lower wedge ring 26, respectively. A cylindrical wedge housing 38 surrounds the split upper and lower wedge rings 20, 28 and the split double-tapered wedge ring 32 and has a threaded lower portion 40 engaging corresponding threads of the well tool 14. The cylindrical wedge housing also has a threaded upper portion 42 engaging threads of a threaded compression ring 44. When the cylindrical wedge housing is rotated, the threaded portions 40, 42 draw the tool 14 and the threaded compression ring 44 into engagement with the split lower wedge ring 26 and the split upper wedge ring 20, respectively, forcing the tapered outer surfaces 28, 22, of the respective wedge rings along the tapered surfaces 36, 34, respectively, of the split double-tapered wedge ring 32 thereby forcing the grapple threads 24, 30 to dig into the outer surface 18 of the coiled tubing 10 and to force the double-tapered wedge ring 32 radially outwardly against the cylindrical wedge housing 38 thereby effecting a strong grapple connection between the coiled tubing 10 and the well tool 14. This circumferential gripping action also has the further advantage in that out-of-round tubing is radially compressed into a substantially circular form.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. A grapple connection for connecting a well tool to coiled tubing having an outer surface comprising:

first and second split rings having an inner surface including grappling means in engagement with said outer surface of said coiled tubing, said first and second split rings each having oppositely tapered conical outer surfaces and radially oriented outer end surfaces;

an intermediate cylindrical split ring having third and fourth conically tapered inner surfaces in abutting engagement with said first and second conical tapered surfaces, respectively;

a cylindrical housing surrounding said first and second split rings and said intermediate split ring, said cylindrical housing having first and second threaded end portions, said first threaded end portion engaging threads located on an outer surface of said tool and said second threaded end portion engaging a threaded portion of a compression ring, whereby a radially oriented surface of said well tool and of said compression ring, respectively, are in abutting engagement with said radially oriented outer end surfaces of said first and said second split ring respectively.

2. The grapple connection as set forth in claim 1 wherein said grappling means comprises buttressed threads.

* * * * *